US005347970A

United States Patent [19]

Pape et al.

[11] Patent Number: 5,347,970

[45] Date of Patent: Sep. 20, 1994

[54] FUEL INJECTION DEVICE FOR INTERNAL COMBUSTION ENGINES

[75] Inventors: Werner Pape, East Grand Rapids, Mich.; Pierre Dronier, Meyzieu, France

[73] Assignee: Robert Bosch GmbH, Stuttgart, Fed. Rep. of Germany

[21] Appl. No.: 167,289

[22] Filed: Dec. 16, 1993

[30] Foreign Application Priority Data

Dec. 23, 1992 [DE] Fed. Rep. of Germany ..... 4243665

[51] Int. Cl.[5] ..... F02M 37/04

[52] U.S. Cl. ..... 123/506; 123/458; 123/198 D; 137/68.1

[58] Field of Search ..... 123/506, 458, 500, 501, 123/198 D, 467; 251/50, 53, 129.07; 137/68.1, 71

[56] References Cited

U.S. PATENT DOCUMENTS

| | | | |
|---|---|---|---|
| 2,918,048 | 12/1959 | Aldinger | 123/506 |
| 4,617,975 | 10/1986 | Rabushka | 137/68.1 |
| 4,653,448 | 3/1987 | Ohmori | 123/458 |
| 4,653,723 | 3/1987 | Rizk | 123/458 |
| 4,971,012 | 11/1990 | Brunnel | 123/198 D |
| 5,050,558 | 9/1991 | Brunel | 123/506 |
| 5,115,783 | 5/1992 | Nakamura | 123/506 |
| 5,239,968 | 8/1993 | Rodriquez-Amaya et al. . | |
| 5,265,804 | 11/1993 | Brunel | 123/506 |
| 5,273,017 | 12/1993 | Braun | 123/506 |

*Primary Examiner*—Carl S. Miller

*Attorney, Agent, or Firm*—Edwin R. Greigg; Ronald E. Greigg

[57] ABSTRACT

A fuel injection device for internal combustion engines, in which the control of the high-pressure delivery of the pump piston is achieved via a magnet valve disposed in a line between the pump work chamber and a fuel tank. To that end, the magnet valve has a valve member, actuated counter to the force of a valve spring by an electrical actuator and the valve member cooperates, by its sealing face with a valve seat and is pressure balanced via a cross-sectional constriction, which is disposed in a pressure chamber that communicates with the pump work chamber. In the event of a fracture of the valve member, in order to avoid blocking of the magnet valve when closed and an attendant uncontrolled, excessive fuel injection quantity, an axial bore is disposed inside the valve member, which bore feeds into a connecting line and on into the low-pressure chamber, and via which the high fuel pressure can drop after the valve member breaks.

8 Claims, 2 Drawing Sheets

FUEL INJECTION DEVICE FOR INTERNAL COMBUSTION ENGINES

BACKGROUND OF THE INVENTION

The invention is based on a fuel injection device, in particular a unit fuel injector for internal combustion engines as defined hereinafter. In a fuel injection device of this kind, known from an earlier German patent application P 41 42 998.2-13, a pump piston axially guided in a cylinder bore of a pump housing is driven to reciprocate by a cam drive. With its face end remote from the cam drive the pump piston defines a pump work chamber in the cylinder bore into which a fuel supply line discharges and which via a pressure conduit communicates with an injection valve protruding into the combustion chamber of the engine to be supplied. Thus not only the onset of the high-pressure delivery of the fuel found in the pump work chamber and therefore the onset of injection, but also the quantity of fuel to be injected is regulated via the diversion process by means of a magnet valve, disposed in the fuel line, which is controlled as a function of the operating parameters of the engine to be supplied.

To this end, the magnet valve has an electrically triggered valve member, which rests against a valve seat in the valve body with a conical valve sealing face disposed on its circumference. In the absence of current, the magnet valve is open; not until there is a supply of current does it bring the valve member into contact with the valve seat, counter to the force of a valve spring, and cause it to close. For the sake of the most minimum possible design of the magnet valve adjusting magnet and of the valve spring, the valve member has an annular cross-sectional constriction at its circumference, at the level of the entry of the high-pressure line from the pump work chamber, and this constriction is furthermore located in an annular chamber in the valve body when the magnet valve is closed, so that the fuel can flow evenly around the valve member, and so that high fuel pressure will act equally on the valve member in both the opening and closing directions of the valve member. As a result, the adjusting forces can be kept correspondingly small.

To cool the magnet valve in the known fuel injection device, a flow of force at low pressure, which is taken from the low-pressure chamber disposed on the underside of the magnet valve via a respective connecting conduit, each of which has a throttle, flows through part of the magnet chamber and immediately thereafter returns to a chamber having a low level of pressure.

The magnet valve of the known fuel injection device has the disadvantage, however, that on high-pressure entry, the valve member is put under a great deal of hydraulic stress at the annular cross-sectional constriction; in both the opening and closing direction of the valve member, the high axial forces acting upon the involved transition surfaces of the cross-sectional constriction can exert a concentration of stress upon the remaining cross section at the narrowest part of the valve member there, which can lead to a fatigue fracture.

If such a pressure occurs, the high axial forces drive the parts of the valve member apart at the point of fracture; the high pump work pressure now acts upon the entire valve member cross section and consequently holds the valve member with its sealing face pressed against the valve seat. The opening force of the valve spring is now no longer sufficient for the valve member to open independently, so that it remains closed throughout the entire stroke of the pump piston, and as a result, the fuel injection device injects the maximum possible supply quantity into the combustion chamber of the engine. This uncontrolled, uncheckable high fuel injection quantity can then lead to an increase in the engine speed above the permissible range, which can eventually destroy the engine.

OBJECT AND SUMMARY OF THE INVENTION

The fuel injection device according to the invention, in particular the unit fuel injector, as defined by the body of claim 1, has the advantage over the prior art that because of the axial bore in the valve member, if this member breaks, an immediate communication opens up between the pump work chamber, which is at high pressure, and the diversion chamber, which is at low fuel pressure; via this communication, the high fuel pressure drops, so that the injection valve closes and no more fuel reaches the combustion chamber of the engine to be supplied. This can be achieved without diminishing the advantages of the pressure-balanced valve member, so that despite the fact that the magnet valve is secured against blocking in the closed position if the valve member breaks, the actuating forces on the valve member remain low, which allows the design of the valve spring and operating magnet to remain as small as possible. Moreover, the axial bore feeds into an existing connecting conduit, which forms a cooling loop, to the low-pressure chamber, so that additional engineering expense can be avoided.

It is especially advantageous to embody the axial bore as a blind bore in the valve member, which begins at the face end of the valve member oriented toward the low-pressure chamber and if the valve member breaks carries the fuel to the low-pressure chamber via a connecting conduit. In manufacturing terms, the blind bore is simple to build into the valve member, and it feeds into the chamber that receives the valve spring, which chamber is integrated into the cooling loop connected with the low-pressure chamber.

A further advantageous embodiment according to claim 3 makes the blind bore open out from an upper annular shoulder of the valve member, which protrudes into the magnet valve; in case the magnet valve member breaks, the fuel can in this embodiment also discharge via this bore into the existing cooling loop communicating with the low-pressure chamber.

It is furthermore advantageously possible to have the axial bore in the valve member feed both into the valve spring-receiving lower region of the cooling loop in the magnet valve, which communicates with the low-pressure chamber, and into its upper region, which protrudes into the magnet valve. As a result, in the event of a fracture of the valve member, two discharge conduits are opened up, enabling rapid pressure relief of the high-pressure chamber.

In order to guarantee secure communication between the high and low-pressure chamber in the event of the fracture of the valve member, the axial bore is embodied wide enough that it extends beyond the region of the valve member having the cross-sectional constriction at the level of the high-pressure entry.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
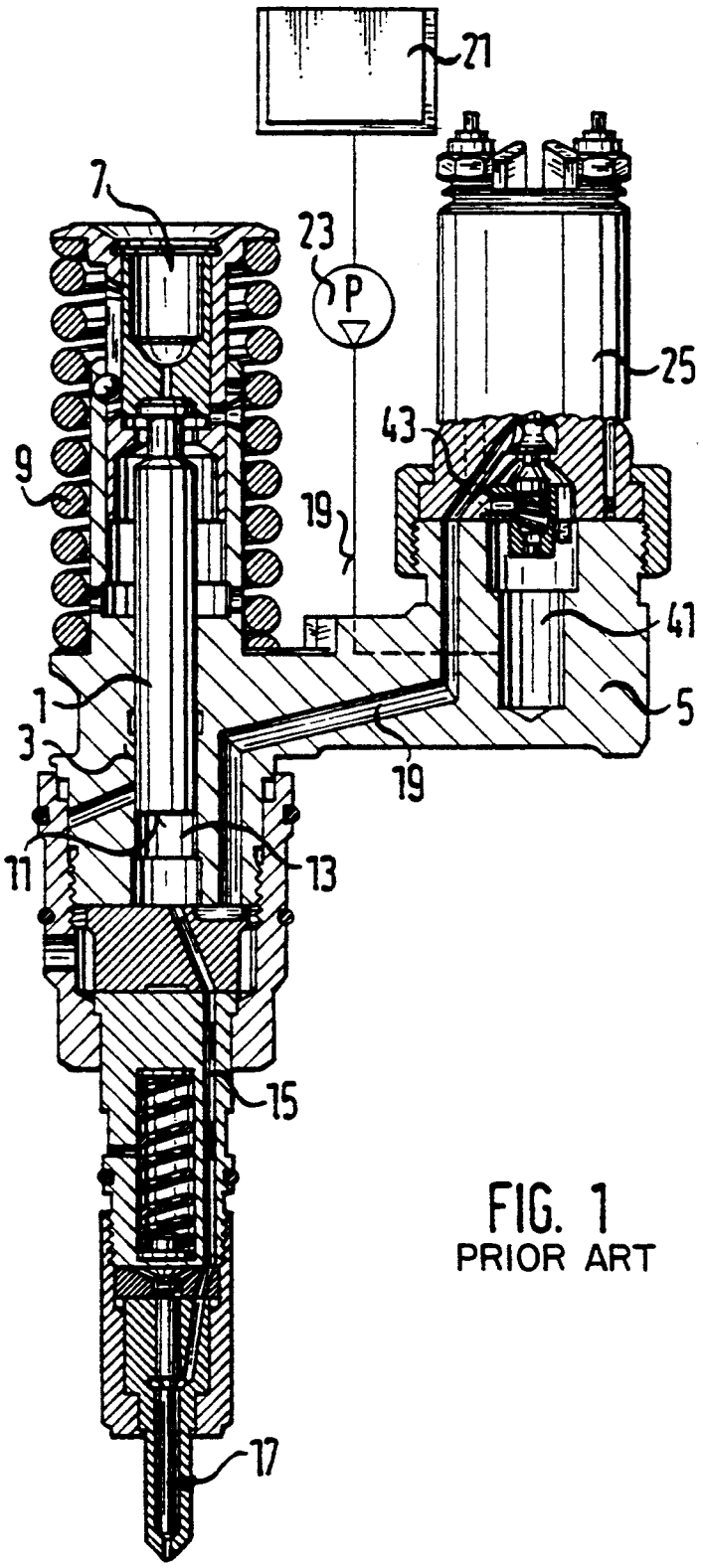
FIG. 1 PRIOR ART
FIG. 1 shows a longitudinal section of a known fuel injection device, from which the installation positions of the magnet valve according to the invention and its fuel connections can be learned.

In the unit fuel injector shown in FIG. 1 to explain the location of the magnet valve, and of which only the regions essential to the invention are described, a pump piston 1 is axially guided in a cylinder bore 3 of a pump housing 5 and is driven axially inward counter to a restoring spring 9 by a cam drive 7, not shown in detail. With its face end 11 remote from the cam drive 7, the pump piston 1 defines a pump work chamber 13 in the cylinder bore 3, at which a pressure conduit 15 begins that connects the pump work chamber 13 to an injection valve 17, which protrudes into a combustion chamber of the engine to be supplied.

Furthermore, a fuel feed line 19, in which a feed pump 23 and a magnet valve 25 are disposed, leads from a schematically shown fuel tank 21, which forms a fuel source, into the pump work chamber 13. Since the filling of the pump work chamber 13 as well as the onset and the end of high-pressure fuel delivery are controlled via the opening and closing of the magnet valve 25 in the fuel line 19, the magnet valve 25 is designed for both functions.

Figure 2:
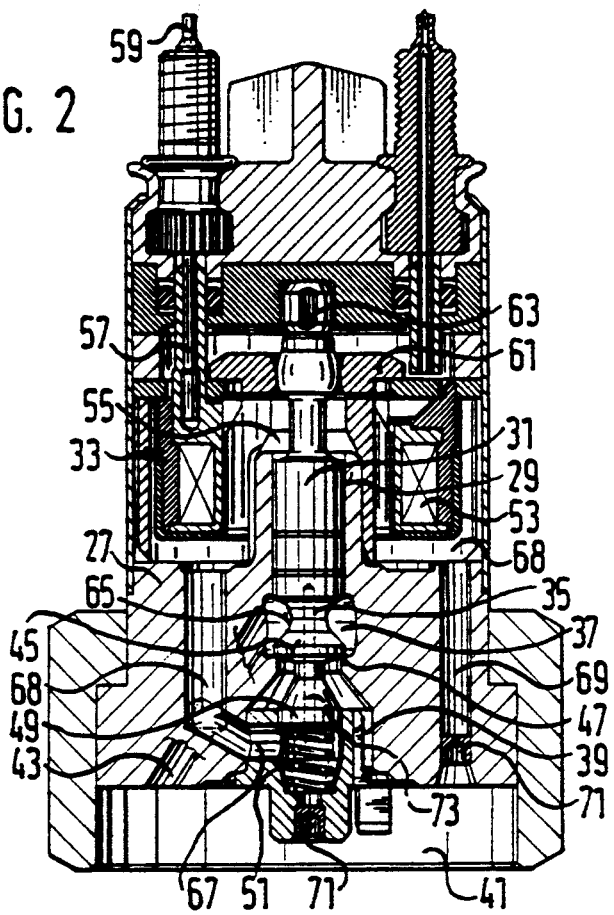
FIG. 2 shows a first exemplary embodiment of the magnet valve, in which the axial bore in the valve member is embodied as a blind bore beginning at the lower face end.
Figure 3:
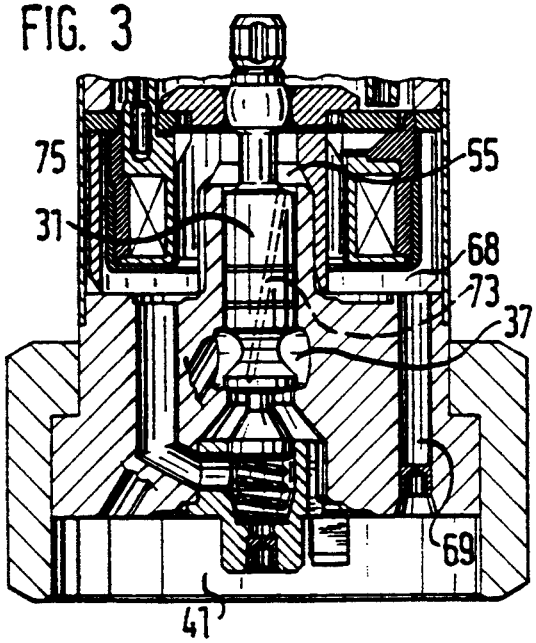
FIG. 3 shows a second exemplary embodiment of the magnet valve, having a blind bore made from above into the valve member.
Figure 4:
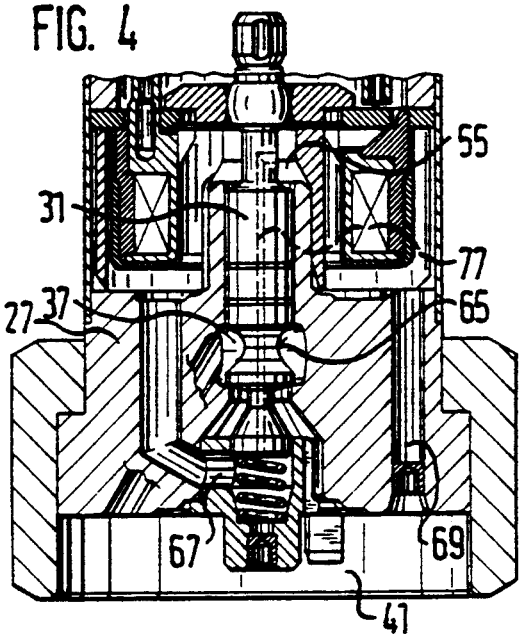
FIG. 4 shows a third exemplary embodiment of the magnet valve, in which the axial bore in the valve member is embodied as a through bore.

The design of the magnet valve 25 to control the high-pressure fuel delivery in the pump work chamber 13 can be learned from FIGS. 2–4; FIG. 2 shows a first exemplary embodiment of the magnet valve 25.

The magnet valve 25 is embodied as a needle valve, whose valve member 31 is axially and sealingly guided in a bore 29 of a valve body 27 that is flange-mounted on the pump housing 5. The valve member 31 is actuated by means of an electric actuator 33 embodied as an electromagnet, and this needle valve is surrounded by an annular pressure chamber 37 in the region of its end portion 35 remote from the actuator 33. On the one side, via an overflow conduit 39 that is coaxial to the valve member 31, leads from the annular chamber 37, and is controlled by the valve member 31, this pressure chamber 37 communicates with a low-pressure chamber 41, which is part of the portion of the fuel line 19 that leads to the fuel supply vessel 21; on the other side, this pressure chamber 37 communicates with the pump work chamber 13, via a portion of the fuel line 19 that forms a high-pressure chamber 43. The closed connection shown in FIG. 2 between the pressure chamber 37 and the low-pressure chamber 41 has a conical valve seat 47 at the transition from the pressure chamber 37 to a first portion of the overflow conduit 39; the valve seat 47 can be closed by a conical sealing face 45 on the valve member 31, and adjoining it, the overflow conduit 39 widens conically. The valve member 33, which opens at the top toward the pressure chamber 37, which can be put under high pressure, carries an end piece 49 on the downstream side, on its end that dips into the conically enlarging region of the overflow conduit 39; this end piece 49 is defined by the conical sealing face 45, and in contact with the sealing face 45 it has a rotationally symmetrical projection that is fitted to the conical contour of the overflow conduit 39 in a streamlined fashion so that the fuel can flow through unhindered.

Furthermore, a valve spring 51, which acts upon the side face of the end piece 49, is disposed in the region of the overflow conduit 39; it acts in opposition to the electromagnetically produced closing force to lift the valve member 31 with its sealing face 45 from the valve seat 47, consequently holding the overflow conduit 39 open in the absence of current to the electromagnet.

The actuator 33, embodied by the electromagnet, comprises a magnet coil 53, disposed in a magnet chamber 55, which can be electrically excited via a connecting cable 57 and a connecting plug 59 and which acts upon the valve member 31 via a dish-shaped armature 61 disposed on the end of the valve member 31 remote from the pressure chamber 37. When the coil 53 is excited, the armature 61 is displaced into contact with the coil and, via the valve member 31, brings the sealing face 45 into contact with the valve seat 47. In the absence of current to the electromagnet, the contrary opening stroke of the valve member 31, which is effected by the valve spring 51, is limited by means of an axial stop 63, which is situated opposite the coil end of the valve member 31.

To cool the magnet valve 25, low-pressure fuel flows through it. To that end, the fuel enters into the magnet chamber 55 via a first portion 67 of a connecting line 68 line, which receives the valve spring 51, and then flows via a second portion 69 of the connecting line 68 back into the low-pressure chamber 41; the connecting line 68 has throttle restrictions 71 at each entry into the low-pressure chamber 41.

To be able to keep the adjustment forces on the valve member 31 as low as possible, this valve member has a rotationally symmetrical cross-sectional constriction 65, forming an annular groove, in the region of the pressure chamber 37, so that whether it is closed or open, a fuel pressure equilibrium prevails at the valve member 31.

If valve member 31 should fracture as a result of a concentration of stress produced by the annular groove in the heavily hydraulically loaded region of the cross-sectional constriction 65, then the high-pressure fuel acts unilaterally on the entire cross-sectional surface of the part of the valve member 31 having the sealing face 45, this part being separate from the part joined to the armature, and counter to the force of the valve spring 51, which is designed for a pressure-balanced valve member 31, keeps the valve member with its sealing face 45 in contact with the valve seat 47; hence the high-pressure delivery is not interrupted, and too much fuel attains injection into the combustion chamber of the engine.

In order to avoid this, in the first exemplary embodiment of the invention, shown in FIG. 2, an axial blind bore 73 that begins at the side face of the valve member 31 oriented toward the low-pressure chamber 41 is made in the valve member 31, deep enough to extend into the region that is at risk from the pressure. In the event of a fracture of the valve member 31, the part of the blind bore 73 on the side of the valve seat 47, which for this part is now a through bore, connects the pressure chamber 37 with the connecting line 68. Consequently, a discharge of the high-pressure fuel out of the high-pressure chamber 43, via the connecting line 68, which forms the cooling loop in the magnet valve 25, and into the low-pressure chamber 41 is made possible, so that the high-pressure injection phase is interrupted.

The second exemplary embodiment shown in FIG. 3 differs from the first one only in the embodiment of the bore on the inside of the valve member 31, which is embodied here as a blind bore 73, which leads obliquely out from an annular shoulder 75, in the upper end of the valve member 31 that protrudes into the magnet chamber 55, and is embodied as protruding into the region of the cross-sectional constriction 65, in the region of the pressure chamber 37. In the event of a fracture of the valve member 31, the high-pressure fuel now flows out of the pressure chamber 37, which communicates with the pump work chamber 13, via the oblique blind bore 73, out of the magnet chamber 55 and the connecting line 68, and into the low-pressure chamber 41 and consequently halts the high-pressure delivery of the pump piston 1.

The third exemplary embodiment shown in FIG. 4 unites the possibilities of the foregoing versions by embodying the bore in the valve member 31 as an axial through bore 77, whose one exit comes out of the valve member 31 on its side facing the pressure chamber and whose other end exits via a portion of a radial bore into the magnet chamber 55. If the valve member 31 fractures at the cross-sectional constriction 65 as a result of the high hydraulic load in the pressure chamber 37, the high-pressure fuel contained therein is released via the resultant two parts of the through bore 77, both into the first part 67 of the connecting line 68 and into the magnet chamber 55, and from there on into the low-pressure chamber 41.

With the fuel injection device according to the invention, it is consequently possible, without additional engineering effort, yet while preserving the pressure-balanced embodiment of the valve member 31, to reliably avoid blocking of the magnet valve 25 while it is closed, along with the attendant excessive fuel injection quantity, if the valve member should break.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines, having a pump piston (1) guided in a cylinder bore (3) of a pump housing (5), the piston being driven axially back and forth by a cam drive (7) and with one face end (11), remote from the cam drive (7), defining a pump work chamber (13), which communicates via a pressure conduit (15) with an injection valve (17 ) that protrudes into the combustion chamber of the engine to be supplied, and which is supplied with fuel from a fuel source (21) via a fuel line (19), which for controlling the high-pressure phase includes an electrically triggered magnet valve (25), whose valve member (31) is actuated by an electric actuator (33), divides a high-pressure chamber (43), formed by the pump work chamber (13) and the adjacent part of the fuel line (19) leading to the fuel source (21), by the contact of a sealing face (45) with a valve seat (47), or opens the communication between the two upon lifting up from the valve seat (47), wherein the valve member (31) has an annular cross-sectional constriction (65) in the region of a pressure chamber (37) that communicates with the high-pressure chamber (43), the valve member (31) has a bore that communicates continuously with the low-pressure chamber (41) and that in the event that the valve member (31) fractures in the region of the cross-sectional constriction connects the high-pressure chamber (43) to the low-pressure chamber (41).

2. A fuel injection device according to claim 1, in which the bore in the valve member (31) is embodied as an axial blind bore (73), which emerges at the face end of the valve member (31) oriented toward the low-pressure chamber (41) beneath the magnet valve (25), and from there communicates continuously with the low-pressure chamber (41) via a connecting line (68, 69).

3. A fuel injection device according to claim 1, in which the bore in the valve member (31) is embodied as an oblique blind bore (73), which emerges at an annular shoulder (75) on the end of the valve member (31) remote from the valve seat (47) and protrudes into the valve body (27), and connects the bore (73) with a magnet chamber (55), which for its part communicates continuously with the low-pressure chamber (41) via the connecting line (69).

4. A fuel injection device according to claim 1, in which the bore in the valve member (31) is embodied as an axial through bore (77), which begins at the face end of the valve member (31) oriented toward the low-pressure chamber (41) beneath the magnet valve (25) and communicates with the magnet valve (25) via the connecting line (69), and feeds into the magnet chamber (55) in the valve body (27), which chamber carries the low-pressure fuel and communicates continuously with the low-pressure chamber (41).

5. A fuel injection device according to claim 1, in which the bore extends in the valve member (31) at least into the region of the cross-sectional constriction (65) of the valve member (31) at the level of the pressure chamber (37).

6. A fuel injection device according to claim 2, in which the bore extends in the valve member (31) at least into the region of the cross-sectional constriction (65) of the valve member (31) at the level of the pressure chamber (37).

7. A fuel injection device according to claim 3, in which the bore extends in the valve member (31) at least into the region of the cross-sectional constriction (65) of the valve member (31) at the level of the pressure chamber (37).

8. A fuel injection device according to claim 4, in which the bore extends in the valve member (31) at least into the region of the cross-sectional constriction (65) of the valve member (31) at the level of the pressure chamber (37).

* * * * *